US008616726B2

(12) United States Patent
Chen

(10) Patent No.: US 8,616,726 B2
(45) Date of Patent: Dec. 31, 2013

(54) LED LAMP ASSEMBLY

(75) Inventor: Chi-Lin Chen, Taipei (TW)

(73) Assignee: USTA Co., Ltd., Taipei (TW)

( * ) Notice: Subject to any disclaimer, the term of this patent is extended or adjusted under 35 U.S.C. 154(b) by 241 days.

(21) Appl. No.: 13/306,630

(22) Filed: Nov. 29, 2011

(65) Prior Publication Data

US 2013/0135864 A1 May 30, 2013

(51) Int. Cl.
*F21V 21/005* (2006.01)
*F21V 21/02* (2006.01)

(52) U.S. Cl.
USPC ..... 362/249.02; 362/249.01

(58) Field of Classification Search
USPC ..... 362/249.01–249.19; 313/318.01, 313/318.12; 439/374–381, 611–619
See application file for complete search history.

(56) References Cited

U.S. PATENT DOCUMENTS

| | | | | |
|---|---|---|---|---|
| 4,263,472 | A * | 4/1981 | Maheu | 174/51 |
| 5,011,033 | A * | 4/1991 | Roth | 220/3.94 |
| 2010/0165626 | A1* | 7/2010 | Lu et al. | 362/249.02 |
| 2012/0327646 | A1* | 12/2012 | Ivey et al. | 362/218 |
| 2013/0088846 | A1* | 4/2013 | Bonarirgo | 362/20 |

* cited by examiner

*Primary Examiner* — Karabi Guharay
*Assistant Examiner* — Nathaniel Lee
(74) *Attorney, Agent, or Firm* — Guice Patents PLLC

(57) ABSTRACT

A LED lamp assembly includes a rectangular electrical box formed of two symmetrical U-shaped frame panels that are detachably fastened together by a tongue-and-groove joint and holding therein a control circuit board that is affixed to two parallel mounting grooves in one U-shaped frame panel by screw nails, a back cover plate and a bracket affixed to the electrical box at two opposite sides for mounting, and an elongated, rectangular light source unit affixed to the bracket and controllable by the control circuit board to emit light.

5 Claims, 6 Drawing Sheets

LED LAMP ASSEMBLY

BACKGROUND OF THE INVENTION

1. Field of the Invention

The present invention relates LED lighting technology and more particularly, to a LED lamp assembly designed for use in a subway tunnel or a wind tower of a wind turbine generating system, which is conveniently detachable, facilitating maintenance and repair works.

2. Description of the Related Art

U.S. application Ser. No. 13/156,988, discloses a LED lamp design entitled "LED LAMP ASSEMBLY FOR USE IN A LONG PASSAGE", which comprises a holder frame carrying a plurality of male/female connectors and a switch and having a rectangular top face, an elongated, rectangular lighting unit having a light-transmissive face and a circuit board therein, the circuit board carrying multiple LEDs and a control circuit that controls the LEDs to emit light through the light-transmissive face, a rectangular plate mounted at the bottom side of the lighting unit and selectively affixed to the holder in one of four equiangularly spaced positions, and a mounting plate extended out of the holder frame. The mounting plate has mounting holes for fastening to support means in a long passage in a parallel manner or at any desired inclined angle relative to the long passage by fastening members.

FIG. 1 illustrates another prior art design of LED lamp assembly. As illustrated, this design of LED lamp assembly comprises an electrical box 91, a back cover plate 92, a mounting plate 93, a light source unit 94, and a control circuit board 95.

According to the aforesaid prior art design, the electrical box 91 is a hollow rectangular frame tube adapted for accommodating the control circuit board 95. The electrical box 91 is a one-pieced member, not detachable. This design of LED lamp assembly requires much installation time and labor, not convenient for maintenance or repair.

SUMMARY OF THE INVENTION

The present invention has been accomplished under the circumstances in view. It is main object of the present invention to provide a LED lamp assembly, which is practical for use in a subway tunnel or a wind tower of a wind turbine generating system. It is another object of the present invention to provide a LED lamp assembly, which is conveniently detachable, facilitating maintenance and repair works.

To achieve this and other objects of the present invention, a LED lamp assembly comprises an electrical box, a back cover plate, a bracket, and a light source unit. The electrical box comprises two symmetrical U-shaped frame panels fastened together to exhibit a rectangular configuration, and a control circuit board mounted in between the two U-shaped frame panels. Each U-shaped frame panel comprises a horizontal wall, a first upright wall and a second upright wall. The first upright wall and the second upright wall are respectively perpendicularly extended from two opposite lateral sides of the horizontal wall in a parallel manner. The first upright wall comprises a coupling groove located on the bottom edge thereof. The second upright wall comprises a coupling flange located on the bottom edge thereof. The coupling flange and coupling groove of one U-shaped frame panel are respectively fastened to the coupling groove and coupling flange of the other U-shaped frame panel. The horizontal wall of each U-shaped frame panel comprises two mounting grooves located on the inside wall thereof in a parallel manner. The control circuit board is affixed to the mounting grooves of one U-shaped frame panel by screw nails. Further, the control circuit board comprises an electrical wire electrically connected to the light source unit. The back cover plate covers one end of the electrical box, having installed therein a power input connector electrically connected to the control circuit board of the electrical box for input of an external power supply. The bracket comprises a front cover panel covering the opposite end of the electrical box, a round hole located on the front cover panel for the passing of the electrical wire of the control circuit board, an extension panel extended from the front cover panel at right angles, and a plurality of mounting through holes located on the extension panel for fastening to an external mount. The light source unit is an elongated rectangular device affixed to the front cover panel of the bracket by screws, comprising a light-transmissive surface located on one side thereof and a LED circuit board mounted therein and carrying a plurality of light-emitting devices. The LED circuit board is electrically connected with the electrical wire of the control circuit board for enabling the control circuit board to control the light-emitting devices to emit light through the light-transmissive surface.

In a second embodiment of the present invention, the LED lamp assembly comprises an electrical box, a back cover plate, a front cover plate, a light source unit, and a bracket. The electrical box comprises two symmetrical U-shaped frame panels fastened together to exhibit a rectangular configuration, and a control circuit board mounted in between the two U-shaped frame panels. Each U-shaped frame panel comprises a horizontal wall, a first upright wall and a second upright wall. The first upright wall and the second upright wall are respectively perpendicularly extended from two opposite lateral sides of the horizontal wall in a parallel manner. The first upright wall comprises a coupling groove located on the bottom edge thereof. The second upright wall comprises a coupling flange located on the bottom edge thereof. The coupling flange and coupling groove of one U-shaped frame panel are respectively fastened to the coupling groove and coupling flange of the other U-shaped frame panel. The horizontal wall of each U-shaped frame panel comprises two mounting grooves located on the inside wall thereof in a parallel manner. The control circuit board is affixed to the mounting grooves of one U-shaped frame panel by screw nails. Further, the control circuit board comprises an electrical wire electrically connected to the LED circuit board. The back cover plate covers one end of the electrical box, having installed therein a power input connector electrically connected to the control circuit board of the electrical box for input of an external power supply. The back cover plate comprises an extension panel extended from the bottom side thereof at right angles, and a plurality of mounting through holes located on the extension panel for fastening to an external mount. The front cover plate covers the opposite end of the electrical box. The light source unit is affixed to the front cover plate, comprising a light-transmissive surface located on one side thereof and a LED circuit board mounted therein and carrying a plurality of light-emitting devices. The LED circuit board is electrically connected with the electrical wire of the control circuit board for enabling the control circuit board to control the light-emitting devices to emit light through the light-transmissive surface. The bracket is affixed to one end of the light source unit opposite to the front cover plate and the electrical box, comprising an extension panel extended from the bottom side thereof at right angles and a plurality of mounting through holes located on the extension panel for fastening to the external mount to which the back cover plate is affixed.

The aforesaid second embodiment, the mounting through holes are respectively located on the back cover plate and the bracket at two distal ends of the LED lamp assembly to fit a different installation requirement.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
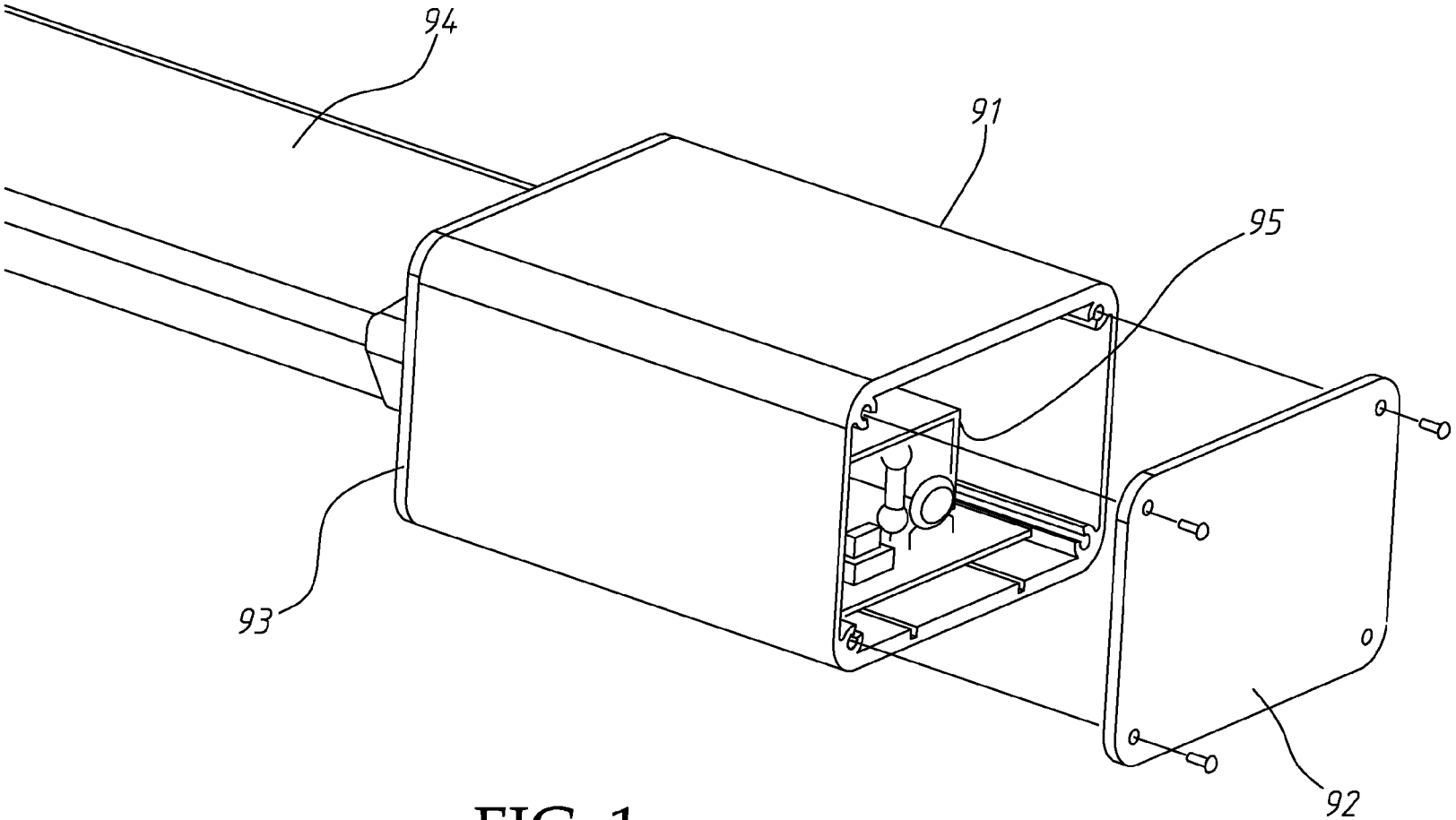
FIG. 1 Prior Art
FIG. 1 is a schematic exploded view of a part of a LED lamp assembly according to the prior art.

Referring to FIGS. 2-5, a LED lamp assembly 100 in accordance with a first embodiment of the present invention generally is shown. The LED lamp assembly 100 comprises an electrical box 11, a back cover plate 12, a bracket 13, and a light source unit 14.

Figures 2, 2A, 2B:
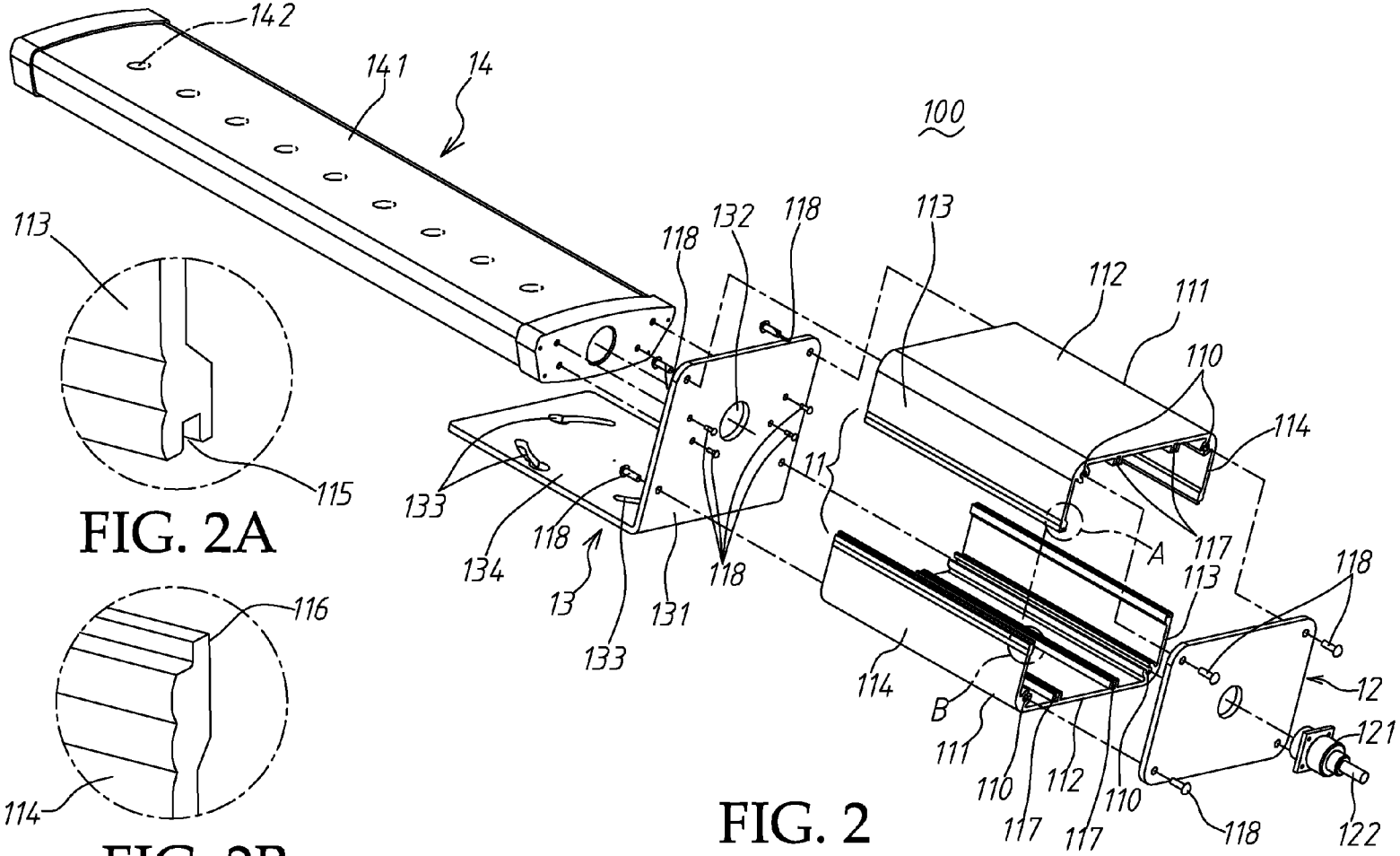
FIG. 2 is an exploded view of a LED lamp assembly in accordance with a first embodiment of the present invention.
FIG. 2A is an enlarged view of Part A of FIG. 2.
FIG. 2B is an enlarged view of Part B of FIG. 2.
Figure 3:
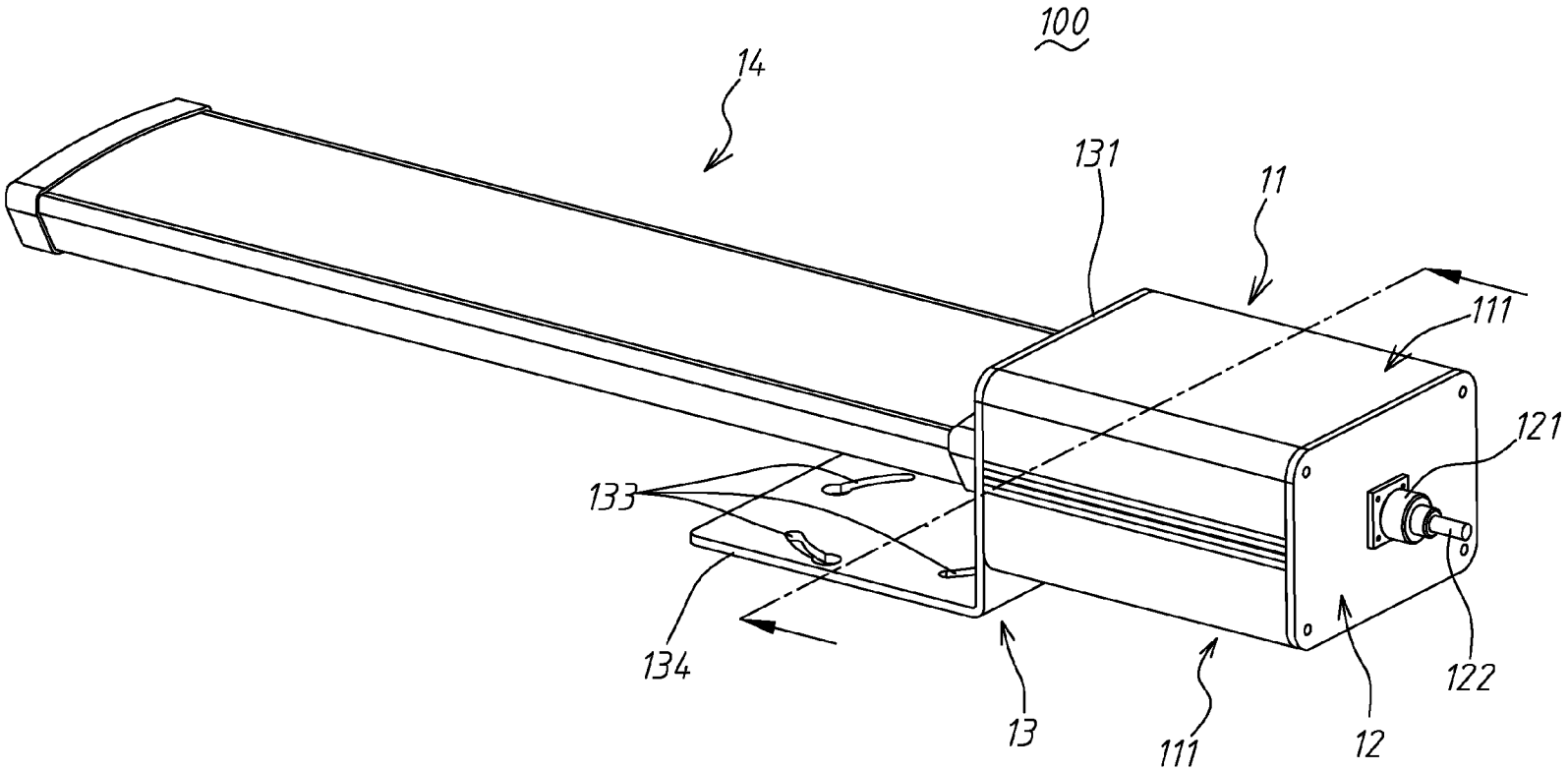
FIG. 3 is an elevational assembly view of the LED lamp assembly in accordance with a first embodiment of the present invention.
Figure 4:
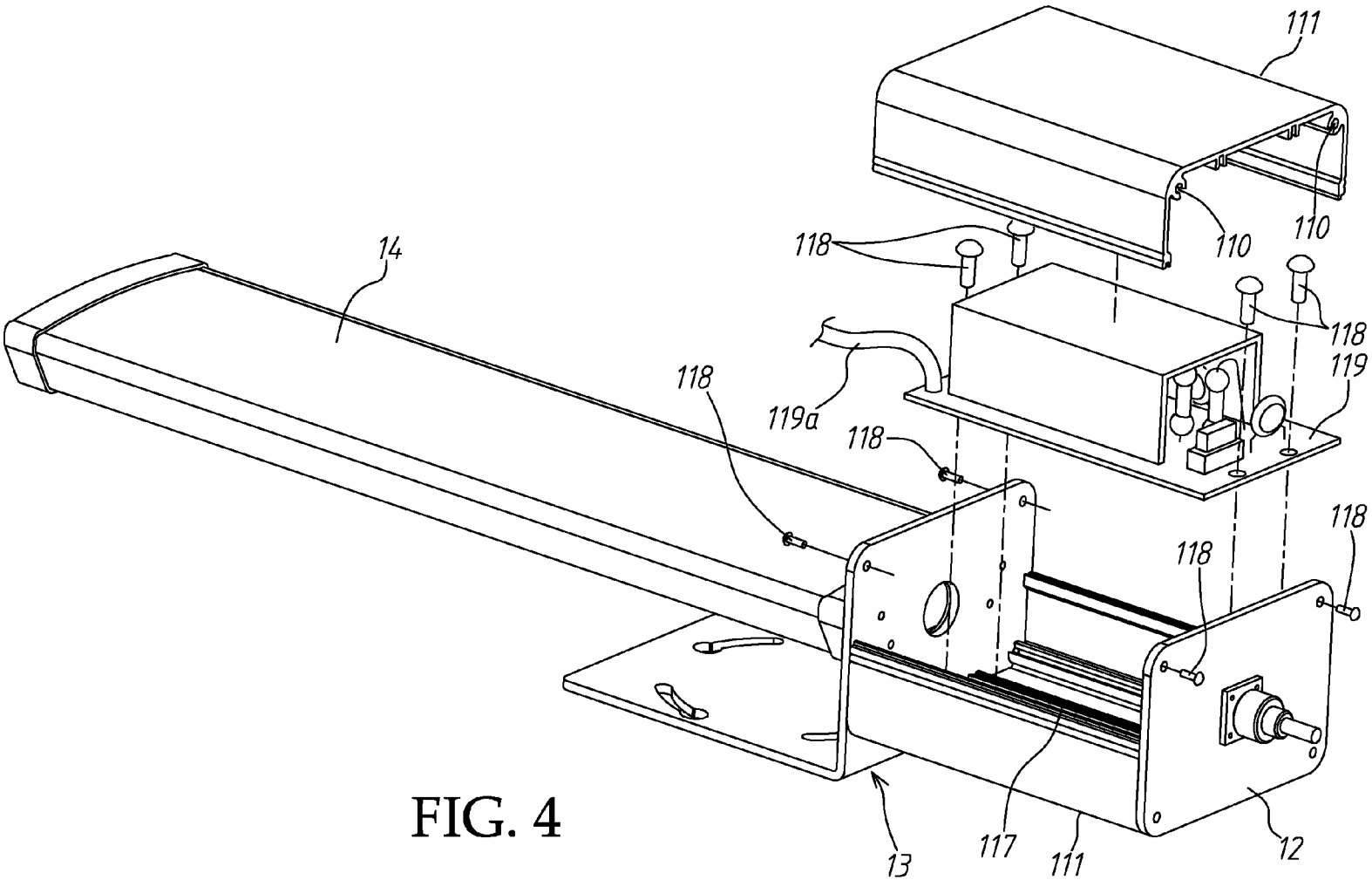
FIG. 4 is an exploded view of the first embodiment of the present invention, illustrating the structure of the electrical box and the control circuit board.
Figure 5:
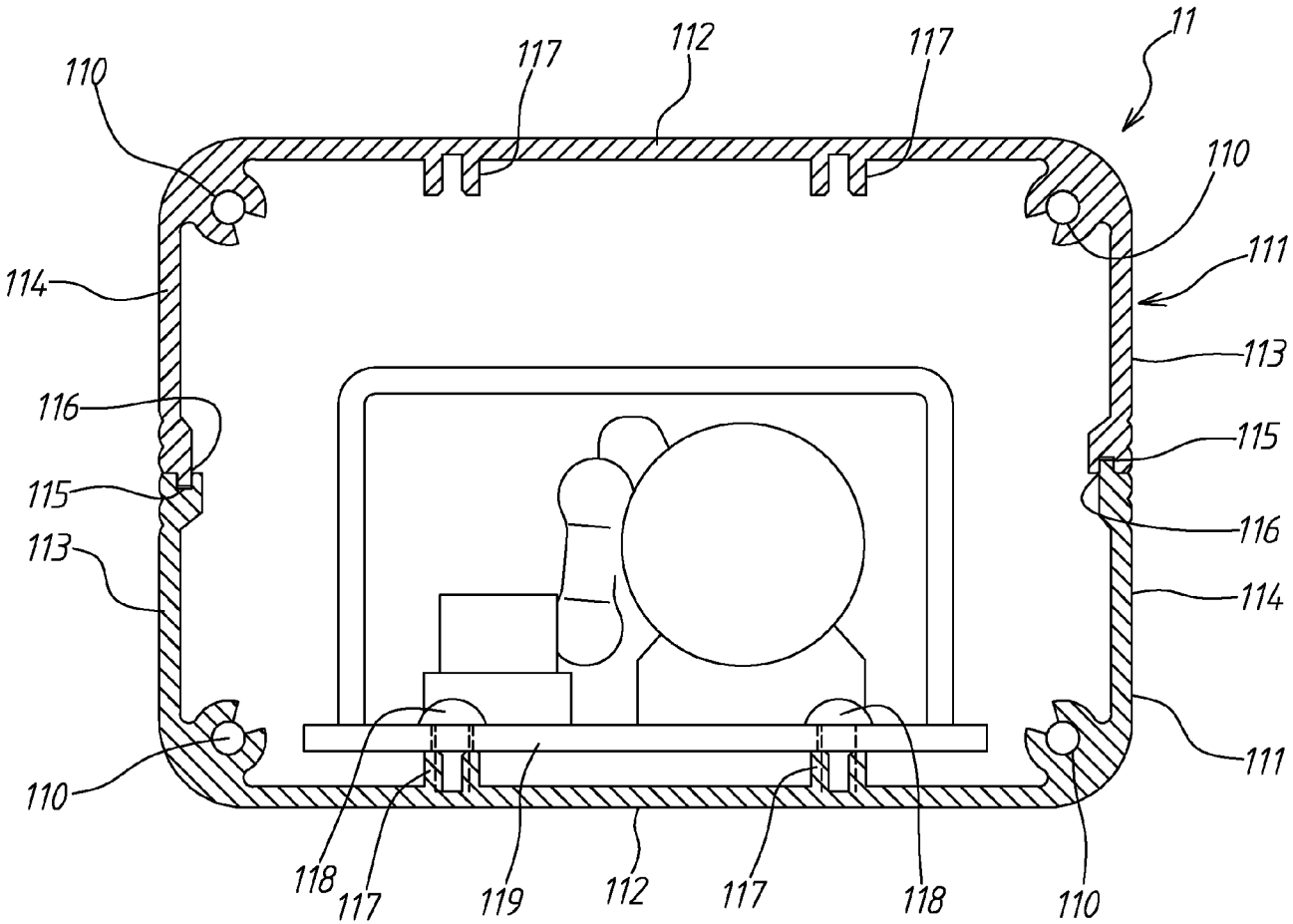
FIG. 5 is a cross-sectional view of the LED lamp assembly in accordance with the first embodiment of the present invention.

The electrical box 11 comprises two symmetrical U-shaped frame panels 111 that are fastened together to exhibit a rectangular configuration, and a control circuit board 19 mounted in between the two U-shaped frame panels 111. Each U-shaped frame panel 111 comprises a horizontal wall 112, a first upright wall 113, and a second upright wall 114. The first upright wall 113 and second upright wall 114 are respectively perpendicularly extended from two opposite lateral sides of the horizontal wall 112 in a parallel manner. The first upright wall 113 has a coupling groove 115 located on the bottom edge thereof, as shown in FIG. 2A. The second upright wall 114 has a coupling flange 116 located on the bottom edge thereof, as shown in FIG. 2B. By means of fastening the coupling groove 115 and coupling flange 116 of one U-shaped frame panel 111 to the coupling flange 116 and coupling groove 115 of the other U-shaped frame panel 111, the two U-shaped frame panels 111 are fastened together, as shown in FIG. 5. The horizontal wall 112 of each U-shaped frame panel 111 has two mounting grooves 117 located on the inside wall thereof in a parallel manner. The control circuit board 19 is affixed to the mounting grooves 117 of one U-shaped frame panel 111 by screw nails 118, as shown in FIGS. 4 and 5. Each U-shaped frame panel 111 further comprises two elongated screw seats 110 respectively located on the inside wall thereof at the junction between the horizontal wall 112 and each of the first upright wall 113 and second upright wall 114.

The back cover plate 12 covers one end of the electrical box 11, having installed therein a power input connector 121 to which a power cable 122 is electrically connected to provide power supply to the control circuit board 119.

The bracket 13 comprises a front cover panel 131 that covers the opposite end of the electrical box 11, a round hole 132 located on the front cover panel 131 for the passing of an electrical wire 119*a* of the control circuit board 119, an extension panel 134 extended from the front cover panel 131 at right angles, and a plurality of mounting through holes 133 located on the extension panel 134 for the mounting of fastening members (not shown) to affix the LED lamp assembly 100 to a mount (not shown) in a subway tunnel or a wind tower of a wind turbine generating system (not shown) in a parallel manner or at any desired inclined angle. Further, the front cover plate 12 and the back cover panel 131 are affixed to the screw seats 110 of the U-shaped frame panels 111 of the electrical box 11 by screws 118.

Further, the aforesaid mounting through holes 133 are elongated and smoothly curved through holes equiangularly located on the extension panel 134.

The light source unit 14 exhibits a rectangular configuration, having a light-transmissive surface 141 located on one side thereof, and a LED circuit board (not shown) mounted therein and carrying a plurality of LEDs (light-emitting devices) 142. The electrical wire 119*a* of the control circuit board 119 is electrically connected with the LED circuit board for driving the LEDs (light-emitting devices) 142 to emit light through the light-transmissive surface 141. Further, the light source unit 14 is fixedly fastened to the front cover panel 131 of the bracket 13 by screws 118. Thus, the light source unit 14 is joined to the electrical box 11.

As stated above, the electrical box 11 consists of the two symmetrical U-shaped frame panels 111 and the control circuit board 19. If the control circuit board 19 fails, loosen some of the screws 118 for allowing removal of one U-shaped frame panel 111 from the other, as shown in FIG. 4, and then repair or replace the control circuit board 19. Thus, the invention facilitates dismounting of the control circuit board 19 for maintenance or repair.

Figure 6:
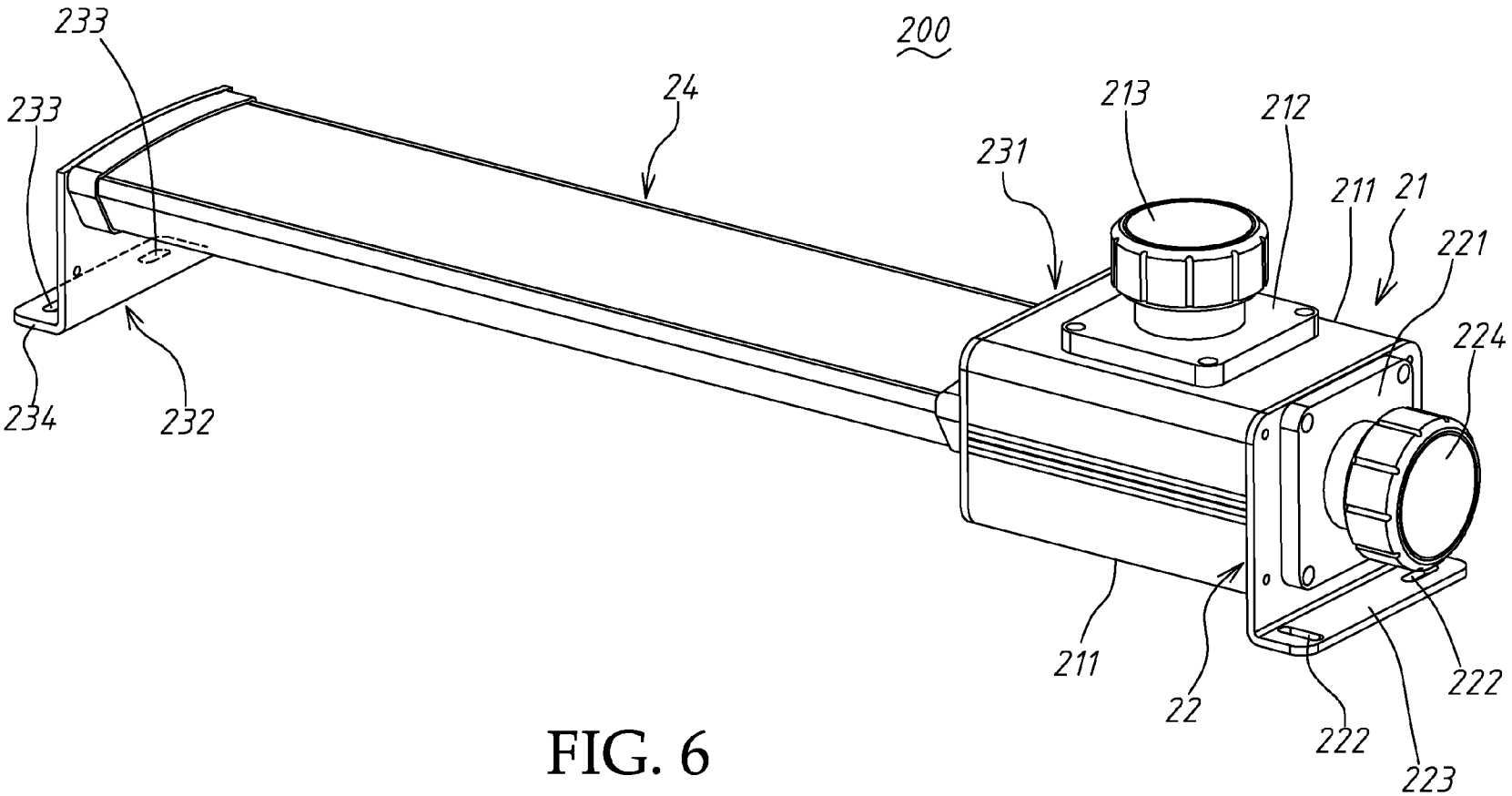
FIG. 6 is an elevational assembly view of a LED lamp assembly in accordance with a second embodiment of the present invention.

Further, modifications can be made to fit different requirements. FIG. 6 illustrates a LED lamp assembly 200 in accordance with a second embodiment of the present invention. According to this second embodiment, the LED lamp assembly 200 comprises an electrical box 21, a back cover plate 22, a front cover plate 231, a bracket 232, and a light source unit 24.

Similar to the aforesaid first embodiment, the electrical box 21 consists of two symmetrical U-shaped frame panels 211 and the control circuit board (not shown). The light source unit 24 of this second embodiment is same as that of the aforesaid first embodiment. Further, the back cover plate 22 covers one end of the electrical box 21, having a power input connector 221 installed therein. The power input connector 221 is openably covered with a round cap 224 for protection. When opened the round cap 224 from the power input connector 221, a power cable (not shown) can be plugged into the power input connector 221 to provide power supply to the control circuit board. Further, the back cover plate 22 has an extension panel 223 extended from the bottom side thereof at right angles, and two mounting through holes 222 located on the first extension panel 223.

The front cover plate 231 covers the opposite end of the electrical box 21. The bracket 232 is affixed to one end of the light source unit 24 opposite to the front cover plate 231, having an extension panel 234 extended from the bottom side thereof at right angles and a plurality of mounting through holes 233 located on the extension panel 234. Fastening members (not shown) are mounted in the mounting through holes 222 of the back cover plate 22 and the mounting through holes 233 of the bracket 232 to affix the LED lamp assembly 200 to a mount (not shown) in a subway tunnel or a wind tower of a wind turbine generating system (not shown).

Further, a power output connector 212 is mounted at the outside wall of one U-shaped frame panel 211 of the electrical box 21 for power output. The power output connector 212 is openably covered with a round cap 213 for protection.

In the aforesaid second embodiment, the mounting through holes 222 and 233 are respectively located on the back cover plate 22 and the bracket 232 at two distal ends of the LED lamp assembly 200 to fit a different installation requirement.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A LED lamp assembly, comprising:

an electrical box comprising two symmetrical U-shaped frame panels fastened together to exhibit a rectangular configuration and a control circuit board mounted in between said two U-shaped frame panels, each said U-shaped frame panel comprising a horizontal wall, a first upright wall and a second upright wall, said first upright wall and said second upright wall being respectively perpendicularly extended from two opposite lateral sides of said horizontal wall in a parallel manner, said first upright wall comprising a coupling groove located on a bottom edge thereof, said second upright wall comprising a coupling flange located on a bottom edge thereof, the coupling flange and coupling groove of one said U-shaped frame panel being respectively fastened to the coupling groove and coupling flange of the other said U-shaped frame panel, the horizontal wall of each said U-shaped frame panel comprising two mounting grooves located on an inside wall thereof in a parallel manner, said control circuit board being affixed to the mounting grooves of one said U-shaped frame panel by screw nails, said control circuit board comprising an electrical wire electrically connectable to a light source unit;

a back cover plate covering one end of said electrical box, said back cover plate having installed therein a power input connector electrically connected to said control circuit board of said electrical box for input of an external power supply;

a bracket comprising a front cover panel covering an opposite end of said electrical box, a round hole located on said front cover panel for the passing of the electrical wire of said control circuit board, an extension panel extended from said front cover panel at right angles, and a plurality of mounting through holes located on said extension panel for fastening to an external mount; and a light source unit affixed to said front cover panel of said bracket by screws, said light source unit comprising a rectangular configuration, a light-transmissive surface located on one side thereof, and a LED circuit board mounted therein and carrying a plurality of light-emitting devices, said LED circuit board being electrically connected with the electrical wire of said control circuit board for enabling said control circuit board to control said light-emitting devices to emit light through said light-transmissive surface.

2. The LED lamp assembly as claimed in claim 1, wherein each said U-shaped frame panel further comprises two elongated screw seats respectively located on an inside wall thereof at the junction between the horizontal wall and each of the first upright wall and second upright wall thereof; said front cover panel of said bracket and said back cover plate are respectively affixed to the screw seats of said U-shaped frame panels of said electrical box by screws.

3. The LED lamp assembly as claimed in claim 1, wherein the mounting through holes of said bracket are elongated and smoothly curved through holes equiangularly located on the extension panel of said bracket.

4. A LED lamp assembly, comprising:

an electrical box comprising two symmetrical U-shaped frame panels fastened together to exhibit a rectangular configuration and a control circuit board mounted in between said two U-shaped frame panels, each said U-shaped frame panel comprising a horizontal wall, a first upright wall and a second upright wall, said first upright wall and said second upright wall being respectively perpendicularly extended from two opposite lateral sides of said horizontal wall in a parallel manner, said first upright wall comprising a coupling groove located on a bottom edge thereof, said second upright wall comprising a coupling flange located on a bottom edge thereof, the coupling flange and coupling groove of one said U-shaped frame panel being respectively fastened to the coupling groove and coupling flange of the other said U-shaped frame panel, the horizontal wall of each said U-shaped frame panel comprising two mounting grooves located on an inside wall thereof in a parallel manner, said control circuit board being affixed to the mounting grooves of one said U-shaped frame panel by screw nails, said control circuit board comprising an electrical wire electrically connectable to a LED circuit board;

a back cover plate covering one end of said electrical box, said back cover plate having installed therein a power input connector electrically connected to said control circuit board of said electrical box for input of an external power supply, said back cover plate comprising an extension panel extended from a bottom side thereof at right angles and a plurality of mounting through holes located on the extension panel for fastening to an external mount;

a front cover plate covering an opposite end of said electrical box;

a light source unit affixed to said front cover plate, said light source unit comprising a light-transmissive surface located on one side thereof, and a LED circuit board mounted therein and carrying a plurality of light-emitting devices, said LED circuit board being electrically connected with the electrical wire of said control circuit board for enabling said control circuit board to control said light-emitting devices to emit light through said light-transmissive surface; and a bracket affixed to one end of said light source unit opposite to said front cover plate and said electrical box, said bracket comprising an extension panel extended from a bottom side thereof at right angles and a plurality of mounting through holes located on the extension panel for fastening to the external mount to which the extension panel of said back cover plate is affixed.

5. The LED lamp assembly as claimed in claim 4, wherein said electrical box further comprises a power output connector mounted at an outside wall of one said U-shaped frame panel for power output, and a round cap for closing said power output connector.

* * * * *